US005174562A

United States Patent [19]

Mizunaga et al.

[11] Patent Number: 5,174,562

[45] Date of Patent: Dec. 29, 1992

[54] PAPER SHEET HANDLING APPARATUS

[75] Inventors: Kazuhiro Mizunaga, Kurita; Takashi Ohno, Mishima; Takashi Hase, Yokohama; Norio Tsuchitani, Soraku, all of Japan

[73] Assignee: Omron Tateisi Electronics Co., Kyoto, Japan

[21] Appl. No.: 731,377

[22] Filed: Jul. 16, 1991

Related U.S. Application Data

[63] Continuation of Ser. No. 434,499, Nov. 13, 1989, abandoned, which is a continuation of Ser. No. 152,554, Feb. 5, 1988, abandoned.

[30] Foreign Application Priority Data

| | | | |
|---|---|---|---|
| Feb. 25, 1987 | [JP] | Japan | 62-40382 |
| Feb. 25, 1987 | [JP] | Japan | 62-40383 |
| Apr. 4, 1987 | [JP] | Japan | 62-89853 |

[51] Int. Cl.[5] ..... B65H 00/00

[52] U.S. Cl. ..... 271/261; 271/263; 271/265

[58] Field of Search ..... 271/227, 228, 261, 263, 271/265

[56] References Cited

U.S. PATENT DOCUMENTS

| | | | |
|---|---|---|---|
| 3,228,681 | 1/1966 | Williams | 271/261 |
| 3,930,582 | 1/1976 | Gartner et al. . | |
| 4,462,587 | 7/1984 | Graef | 271/263 |
| 4,491,929 | 1/1985 | Ikoma | 271/263 X |
| 4,511,242 | 4/1985 | Ashbee | 271/227 X |
| 4,700,368 | 10/1987 | Munn | 271/263 X |
| 4,741,526 | 5/1988 | Reed | 271/263 X |
| 4,761,002 | 8/1988 | Reed | 271/263 X |
| 4,939,676 | 7/1990 | Worsley | 271/261 X |

FOREIGN PATENT DOCUMENTS 0025976 1/1981 European Pat. Off. .

*Primary Examiner*—Richard A. Schacher

*Attorney, Agent, or Firm*—Dickstein, Shapiro & Morin

[57] ABSTRACT

Two thickness detectors (5) each for outputting an electric signal representing the thickness of a paper sheet (B) passing thereby are arranged side by side in the width direction of a paper sheet conveyance path (3). Parameters such as paper sheet thickness, length, the existence of skew and, if skew exists, the skew angle ($\theta$), are calculated based on the output signals from the thickness detectors. This facilitates detection of two or more overlapping bank notes among a wide variety of bank notes having different thicknesses or in case of a bank note having a significantly non-uniform thickness. The correct thickness of a paper sheet is also obtained at all times by using the skew angle and the reference length (W) of the paper sheet. This not only facilitates detection of two overlapping bank notes among a wide variety of bank notes having different thicknesses or in case of a bank note having a significantly non-uniform thickness, but also enables detection to be made very accurately. The number of paper sheets being conveyed past the thickness detectors at one time is determined based on the output signals of the thickness sensors. If the number of sheets has been reliably determined, this number of sheets is released even when sheets are being conveyed in an overlapping state and not just singly.

19 Claims, 10 Drawing Sheets

Fig.9

| RIGHT DISPLACEMENT SENSOR | LEFT DISPLACEMENT SENSOR |
|---|---|
| | |
| | |
| | |
| SAMPLING DATA | |
| | |
| SUM (INTEGRATED VALUE) | SUM (INTEGRATED VALUE) |
| BANK NOTE PRESENCE FLAG | BANK NOTE PRESENCE FLAG |
| END FLAG | END FLAG |
| | |

MEMORY 25

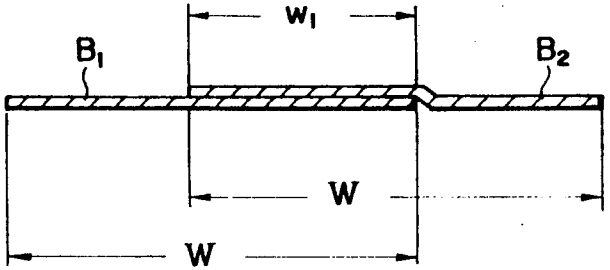
Fig.12
Fig.14
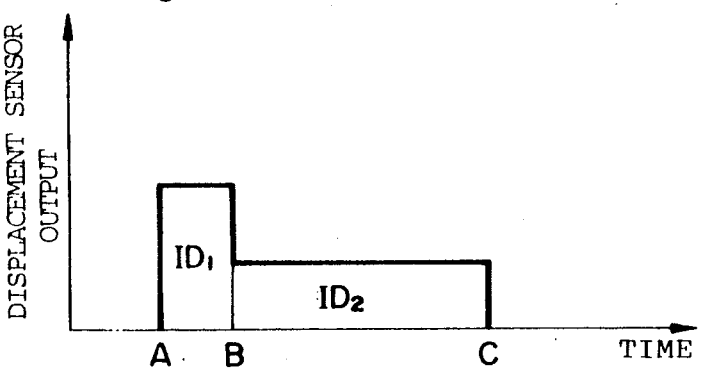
Fig.13
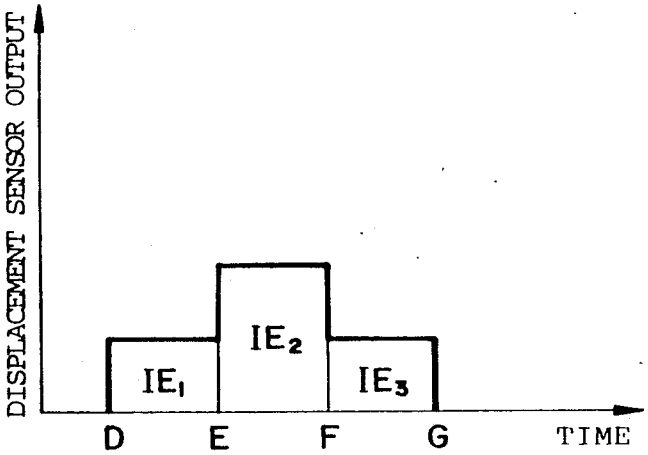
Fig.15

PAPER SHEET HANDLING APPARATUS

This is a continuation of application Ser. No. 07/434,499, filed Nov. 13, 1989, now abandoned, which in turn is a continuation of application Ser. No. 07/152,554, filed Feb. 5, 1988, now abandoned.

BACKGROUND OF THE INVENTION

This invention relates to an apparatus for handling conveyed paper sheets inclusive of bank notes. Examples of the paper sheet handling apparatus include an apparatus for sensing the parameters of paper sheets (parameters such as thickness, length, the existence of skew and, if skew exists, the angle of skew), and an apparatus which uses sensed parameters to count the number of paper sheets and release the number of paper sheets counted. The paper sheet handling apparatus is provided, for example, in a transaction processing unit such as an automated teller's machine (ATM) or automatic cash dispenser (CD). A specific example of the apparatus is a machine for releasing or discharging bank notes.

A bank note releasing machine is adapted to release or discharge a given number of bank notes and is equipped with a bank note thickness detector which, in order to assure that the released bank notes are counted correctly, senses whether the bank notes are being conveyed one at a time or whether two or more bank notes are superimposed while being conveyed. Such thickness detectors are either of a mechanical type using a cam or of an optical type relying upon a photosensor.

One type of the mechanical arrangement has a freely rotatable cam arranged between opposing members leaving a gap equivalent to the thickness of a single bank note. When two or more superimposed bank notes are conveyed past the cam, the latter rotates to sense the event. Thus, this arrangement is only capable of sensing the passage of one bank note or more than one bank note. Accordingly, the conventional bank note releasing machine performs a bank note releasing operation only if passage of one bank note is determined; if two or more bank notes are superimposed, these are recovered or collected within the machine without being released. The mechanical arrangement using the cam also has a number of other drawbacks. For example, in order for it to be applied to a wide variety of bank notes of different thicknesses, one arrangement must be provided for each type of bank note. Reliability is low with regard to bank notes having a large variation in thickness, as is the case when one and the same note has a thickness that differs depending on the location. In addition, the sensed thickness varies depending upon the frictional coefficient of the bank notes, and sensing errors occur due to bank notes whose edges are folded or which are wrinkled. Moreover, length in the direction of note conveyance cannot be measured.

The optical arrangement is adapted to sense two superimposed bank notes by measuring the amount of transmitted light in the thickness direction of the bank notes. The problem with this expedient is poor reliability caused by bank notes which are soiled.

SUMMARY OF THE INVENTION

An object of the present invention is to provide a paper sheet handling apparatus in which accurate information relating to the paper sheets being conveyed can be obtained.

Another object of the invention is to provide a paper sheet releasing machine capable of minimizing the number of paper sheets requiring to be recovered or collected within the machine.

A further object of the invention is to provide a paper sheet parameter detecting apparatus in which an electric signal indicative of paper sheet thickness can be obtained, thereby making it possible to deal with variations in paper sheet thickness, and in which a high reliability is assured even if paper sheets are soiled, which apparatus also makes it possible to sense length in the conveyance direction of the paper sheets as well as any skewing of the paper sheets.

Still another object of the invention is to provide a paper sheet thickness detecting apparatus capable of detecting the thickness of paper sheets precisely even if the paper sheets are conveyed in a bent, folded or soiled state.

A paper sheet handling apparatus according to the present invention comprises at least two thickness detectors arranged side by side at a suitable spacing in a direction perpendicular to that in which paper sheets are conveyed, and means for forming information relating to the conveyed paper sheets based on output signals produced by the thickness detectors.

In accordance with the invention, signals indicative of the paper sheet thickness are obtained from the thickness detectors, which are spaced apart a predetermined distance in the width direction. Accordingly, information relating to the paper sheets being conveyed can be accurately detected by using the leading and trailing edges of the signals outputted by the thickness detectors, the duration times of the signals and values represented by these signals. Since the thickness of the paper sheets can be detected directly, the results are not influenced by grime on the paper sheets.

One item of information relating to the paper sheets is the number of sheets. Accurate detection of the number of paper sheets being conveyed past the thickness detectors at one time makes it possible to control the release of the paper sheets.

A paper sheet releasing apparatus according to the present invention comprises at least two thickness detectors arranged side by side at a suitable spacing in a direction perpendicular to that in which paper sheets are conveyed, means for calculating the number of paper sheets being conveyed based on output signals produced by the thickness detectors, and means for counting the calculated number of paper sheets as a number of paper sheets which has been released or discharged.

In accordance with the invention, the number of paper sheets can be counted accurately not only when sheets are conveyed one at a time but also when two or more sheets are conveyed in a superimposed state. As a result, as many sheets as possible can be dispensed without recovering sheets unnecessarily.

Information relating to the paper sheets refers to paper sheet parameters. A paper sheet parameter detecting apparatus according to the present invention comprises at least two thickness detectors arranged side by side at a suitable spacing in a direction perpendicular to that in which paper sheets are conveyed, and arithmetic means for calculating parameters of the conveyed paper sheets based on output signals produced by the thickness detectors. Each of the thickness detectors comprise a receiving member provided on one side of the conveyance path of the paper sheets, a detecting roller provided opposite the receiving member on other side of the conveyance path and urged in a direction to contact the receiving member, the detecting roller being free to move toward and away from the receiving member, and a displacement sensor for outputting an electric signal representing an amount of displacement of the detecting roller displaced by a paper sheet conveyed between the receiving member and the detecting roller.

When a paper sheet is conveyed between the receiving member and the detecting roller, the detecting roller is displaced by an amount equivalent to the thickness of the paper sheet and the amount of detecting roller displacement is sensed by the displacement sensor, whereby a signal indicative of the thickness of the paper sheet is obtained. The signal has a value which varies with a change in the thickness of the paper sheet and gives a direct representation of the change in paper sheet thickness. This makes it possible to deal with paper sheets of any thickness.

Not only thickness but various other parameters such as length, the existence of skew and the angle of skew if the later exists can be obtained by using the leading and trailing edges of the signals outputted by the thickness detectors, the duration times of these signals and values represented by these signals, as mentioned above.

An apparatus for detecting the thickness of paper sheets in accordance with the invention comprises at least two thickness detectors arranged at a suitable spacing in a direction perpendicular to that in which paper sheets are conveyed, means for measuring a time difference between leading edges of output signals from the two thickness detectors and detecting a skew angle of a conveyed paper sheet by using the measured time difference, means for integrating the output signal from at least one of the two thickness detectors over a period of time required for the paper sheet to pass, and arithmetic means for calculating the thickness of the paper sheet from the detected skew angle, the integrated value and a reference length in the conveyance direction of the paper sheets.

In accordance with the invention, a signal indicative of the thickness of a paper sheet is obtained. The signal has a value which varies with a change in the thickness of the paper sheet and gives a direct representation of the change in paper sheet thickness. This makes it possible to deal with paper sheets of any thickness.

At least a pair of the thickness detectors is provided, with the detectors being spaced apart a prescribed distance in the width direction. By using a time difference between the output signals produced by the two thickness detectors, it is possible to determine whether a conveyed paper sheet is skewed. If the paper sheet is skewed, data indicating the angle of skew can be obtained.

In accordance with the invention, an integrated value of the output signal from at least one of the thickness detectors is measured and represents the product of the thickness and length of a paper sheet. In the computation of sheet thickness, a standard (reference) length conforming to the type of paper sheet is employed as the length of the paper sheet whose thickness is to be calculated. This makes it possible to detect the thickness of a paper sheet very accurately. Moreover, when a paper sheet is detected to be in a skewed state, the detected angle of skew is used in the computation of thickness. Therefore, even if a conveyed sheet of paper is skewed, it is possible to detect the thickness of the paper sheet correctly. Thickness can also be detected correctly in the following case: For example, even if a paper sheet is conveyed in a bent or folded state in part so that the actual length thereof is shorter than the aforementioned standard length, the thickness of the sheet can still be calculated by using the standard length. Since the thickness of the folded or bent portion is greater than the thickness of the other portions of the sheet so that the integrated value will be affected by an amount corresponding to this amount of greater thickness, the thickness calculated using the standard length will be substantially the same as that of a paper sheet which is not bent or folded. Accordingly, thickness can be accurately detected even if the a paper sheet is conveyed in a folded state.

BRIEF DESCRIPTION OF THE DRAWINGS

FIG. 9 is a memory map illustrating a portion of a memory;

FIG. 12 is an enlarged sectional view illustrating a conveyed bank note when a portion thereof is in a folded state;

FIG. 13 is a waveform diagram illustrating an output signal from one of left and right displacement sensors when the conveyance state of FIG. 12 prevails;

FIG. 14 is an enlarged sectional view illustrating a state in which two bank notes partially overlap each other;

FIG. 15 is a waveform diagram illustrating an output signal from one of left and right displacement sensors when the conveyance state of FIG. 14 prevails.

DETAILED DESCRIPTION OF THE PREFERRED EMBODIMENTS

This embodiment of the invention is applied to a bank note releasing machine in a transaction processing unit such as an ATM or CD. A bank note releasing machine is adapted to deliver and discharge a commanded number of bank notes accommodated in a bank note storage bin. A bank note count detecting apparatus is used in order to count the number of bank notes delivered from the bin.

Also disclosed in this embodiment are a bank note parameter detecting apparatus and a bank note thickness detecting apparatus. These apparatus are used for counting the number of bank notes delivered from the bin. In order to count the number of bank notes, it is necessary to sense whether a single bank note is being conveyed correctly or whether two or more bank notes are being conveyed while in a superimposed state.

Figure 1:
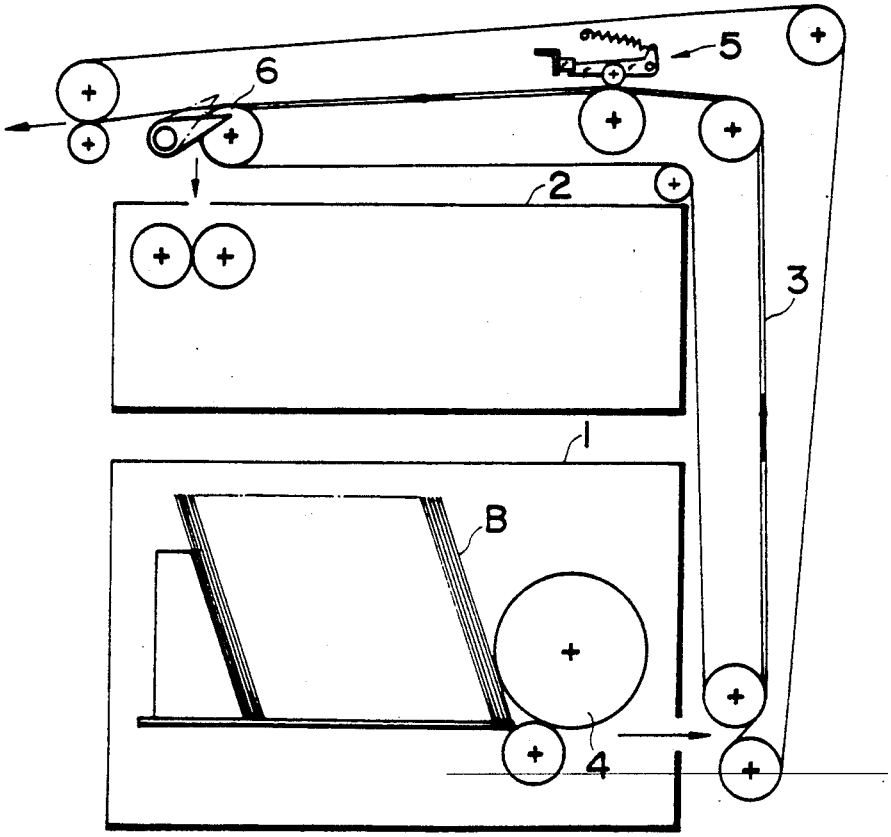
FIG. 1 is a schematic view illustrating the mechanism of a bank note releasing machine.

FIG. 1 illustrates a portion of the arrangement of the bank note releasing machine. A bank note storage bin 1 arranges and accommodates a large number of bank notes B in an inclined but nearly vertical state. In principle, the bank notes B are delivered from the bin 1 one at a time by a feed roller 4 and are conveyed along a conveyance path 3. The conveyance path 3 comprises belts which embrace the bank notes B from both surfaces thereof and a number of rollers or pulleys about which the belts are wound. Two side-by-side bank note thickness detectors 5 are provided substantially midway along the conveyance path 3. As will become apparent from the following discussion, the thickness, length, skew angle and number of bank notes being conveyed past the thickness detectors 5 are measured based on output signals from these thickness detectors 5. If the measured values for a bank note fall within allowable release limits, a changeover flapper 6 is held in the attitude indicated by the solid lines so that the bank note will be delivered to a temporary holding mechanism (not shown) constituting the next stage of the system. If a measured value is not within the allowable limits, e.g. if the number of bank notes is unknown (or if it is determined that two bank notes are being conveyed in an overlapping state), or if it is determined from the measured value of thickness or length that a bank note is not of a prescribed type, the flapper 6 is changed over as indicated by the phantom lines in FIG. 1 so that the pertinent bank note or notes may be recovered in a recovery or collection bin 2. Though it is permissible to accommodate different kinds of bank notes in mixed fashion in the single storage bin 1, a storage bin generally is provided for each type of bank note. In such case it would be possible for the different types of bank notes delivered from these plurality of storage bins to be conveyed along the same conveyance path 3. In other words, the bank note thickness detector 5 in accordance with the invention is applicable to bank notes of a plurality of kinds.

Figure 2:
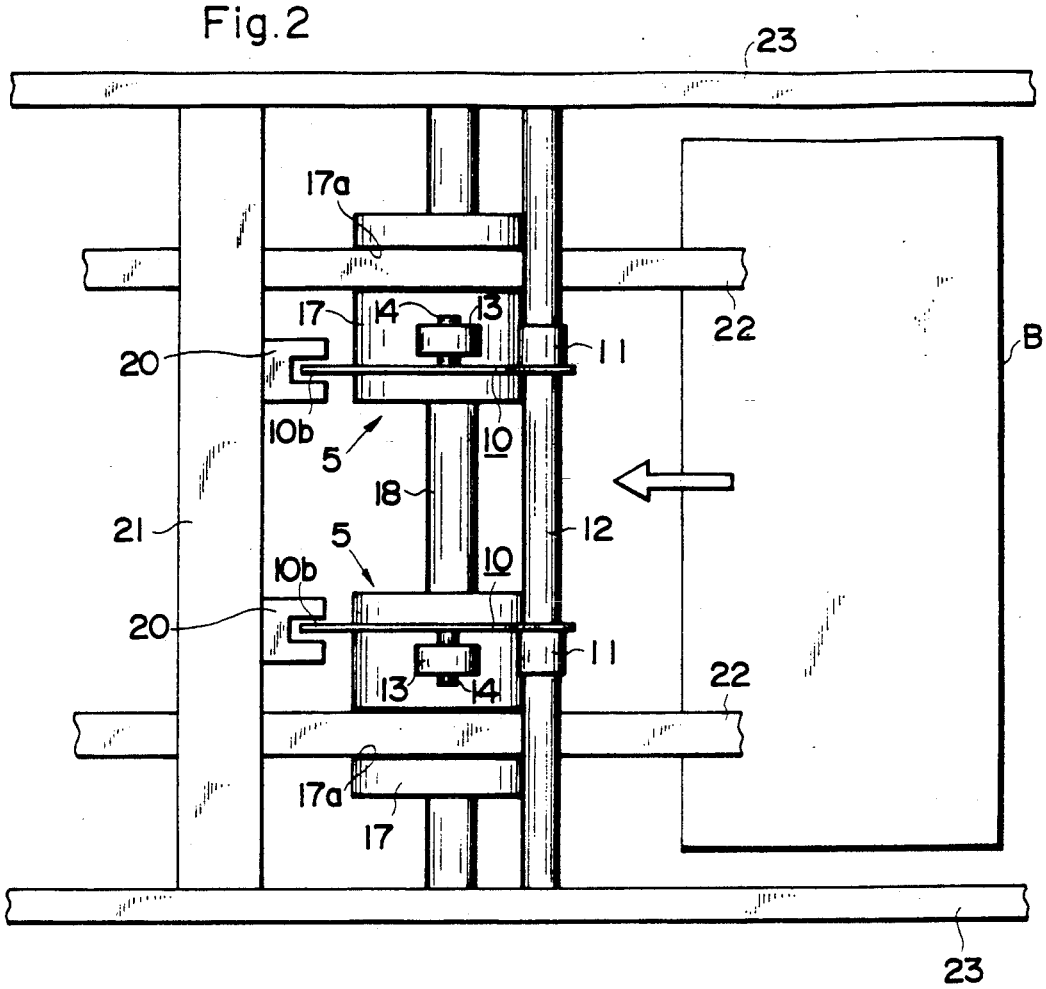
FIG. 2 is a plan view and FIG. 3 a sectional view illustrating a thickness detector.
Figure 3:
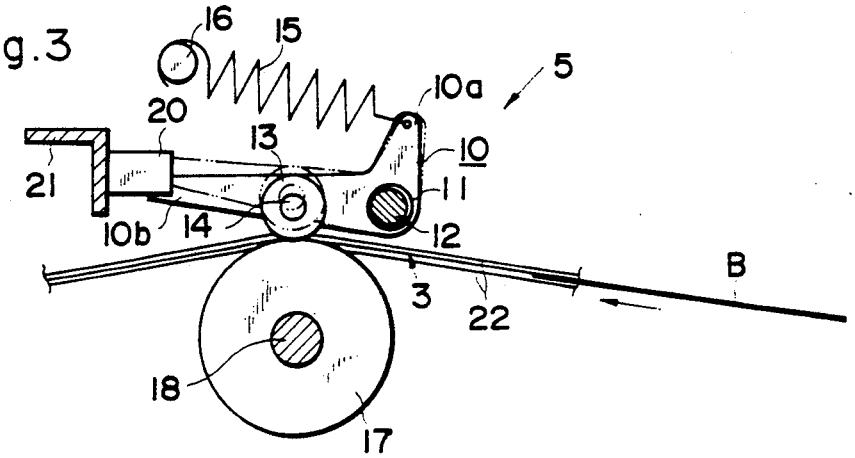

FIGS. 2 and 3 illustrate the arrangement of the bank note thickness detectors 5.

As shown in FIGS. 2 and 3, a bank note B while embraced by upper and lower conveyor belts 22 is conveyed along the conveyance path 3 in an attitude where the longitudinal direction of the bank note is perpendicular to the conveyance direction. The two thickness detectors 5 are arranged side by side a suitable distance apart in a direction (the width direction of the conveyance path 3) perpendicular to the conveyance direction. Arranged immediately below these detectors 5 are respective rollers 17. A shaft 18 spans frames 23 on both sides and supports the rollers 17 for free rotation. The rollers 17 are formed to include respective grooves 17*a* with which the lower belts 22 are engaged. The circumferential surfaces of the rollers 17 extend from the grooves so as to be flush with or project beyond the embracing surfaces of the belts 22.

Since the two thickness detectors 5 are identical in construction, only one of them will be described. The thickness sensor 5 includes a detecting lever 10. The latter is of a generally L-shaped configuration and has two end portions 10*a*, 10*b*. A curved portion of the detecting lever 10 near the end portion 10*a* thereof is formed to include a boss 11. By passing a support shaft 12, which is secured to the frames 23, through the interior of the boss 11, the lever 10 is freely rockably supported about the shaft 12. The detecting lever 10 is extended a considerable length in the direction of the end portion 10*b* and is provided at a point generally midway along its length with a detecting roller 13 free to rotate about a shaft 14. A tension spring 15 is provided between the end portion 10*a* of detecting lever 10 and a spring anchor 16 fixedly secured to the corresponding frame 23. As a result, the detecting lever 15 is biased by the spring 15 so as to urge the detecting roller 13 into pressured contact with the roller 17. The detecting roller 13 contacts the peripheral surface of the roller 17 where the roller 17 is not in contact with the belt 22.

When the bank note B is introduced between the roller 17 and detecting roller 13 in a state embraced by the belts 22, the detecting roller 13 moves away from the roller 17 by an amount equivalent to the thickness of the bank note. As a result, the detecting lever 10 rocks as indicated by the phantom lines in FIG. 3. Since the detecting roller 13 is provided between the end portion 10*b* and the shaft 12, the amount of displacement of the end portion 10*b* is greater than that of the detecting roller 13. Thus, the amount of displacement is magnified by the action of the detecting lever 10.

The amount of displacement of the end portion 10*b* of detecting lever 10 is sensed by a displacement sensor 20 secured to a mounting member 21 fixed to the corresponding frame 23. The displacement sensor 20 has a light projector (a light-emitting element such as a light-emitting diode) and a light receiver (a light-receiving element such as a phototransistor) for receiving the light from the light projector (see FIG. 4). The light projector and light receiver are provided at mutually opposing positions on either side of the end portion 10*b* of detecting lever 10. When a bank note is not present between the roller 17 and the detecting roller 13, the optical path of the light from the light projector is almost totally unimpeded by the end portion 10*b* of detecting lever 10, so that most of the light is received by the light receiver. When one bank note is introduced between the rollers 13, 17, causing the detecting lever 10 to rock, part of the optical path is blocked due to displacement of the end portion 10*b*. When two bank notes are introduced between the rollers 13, 17 simultaneously, the amount of displacement of the end portion 10*b* is doubled and, hence, most of the optical path is blocked by the end portion 10*b*, as a result of which the amount of light received by the light receiver becomes very small. If the total thickness not only of two bank notes but of three of more bank notes is to be within the detectable range, then the diameter of the projected light beam from the projector and the light reception range of the light receiver should be set so as to cover the range of displacement of the end portion 10*b* of lever 10 caused when three or more bank notes are introduced between the rollers 13, 17.

Figure 4:
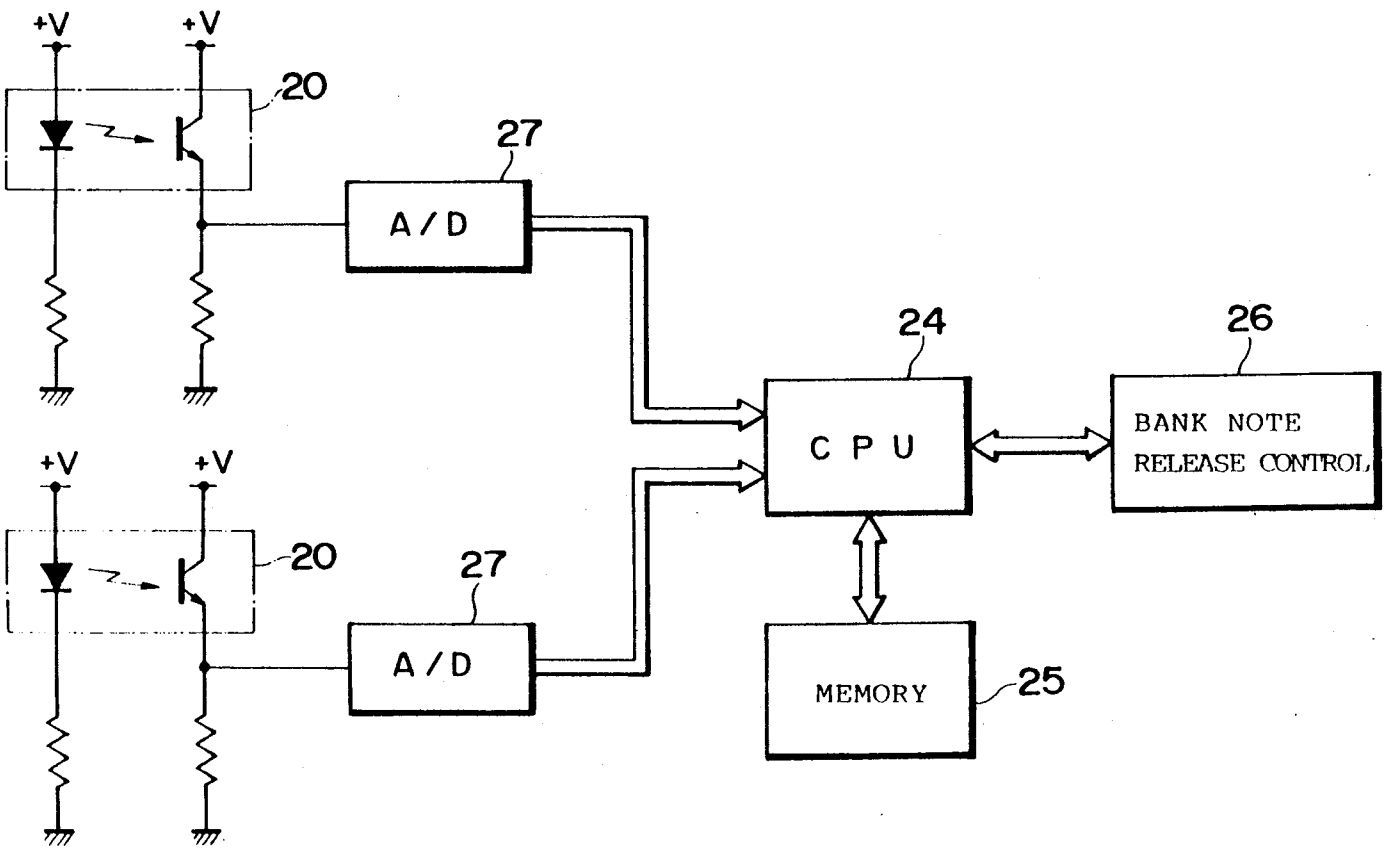
FIG. 4 is a block diagram illustrating the electrical arrangement of an apparatus for detecting a number of bank notes.

FIG. 4 illustrates the general features of the electrical arrangement of a bank note count detecting apparatus (or a parameter detecting apparatus or thickness detecting apparatus) which includes the displacement sensors 20 of thickness detectors 5 described above.

The output of the displacement sensor 20, namely the output electric signal from the light receiver, is sampled at a fixed period. The sampled output value is converted into a digital value by an A/D converter circuit 27, which digital value is accepted by a CPU 24. The CPU 24 has a memory 25 for storing an execution program and various data. A bank note release controller 26 controls the drive of the feed roller 4 in the bank card storage bin 1, the drive of the rollers constituting the conveyance path 3, and the changeover of the flapper 6 and operates in accordance with commands from the CPU 24.

The principle for measuring bank note thickness, bank note length (length along the conveyance direction which, in this embodiment, is the width direction of the bank notes), the existence of skew and, if skew exists, the angle of skew, as well as the number of bank notes, will now be described.

Figure 5:
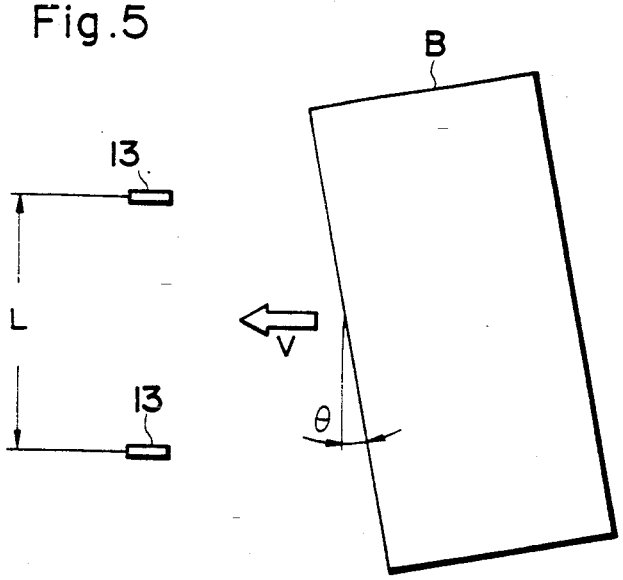
FIG. 5 is a plan view illustrating the relationship between a bank note being conveyed and detecting rollers.
Figure 6:
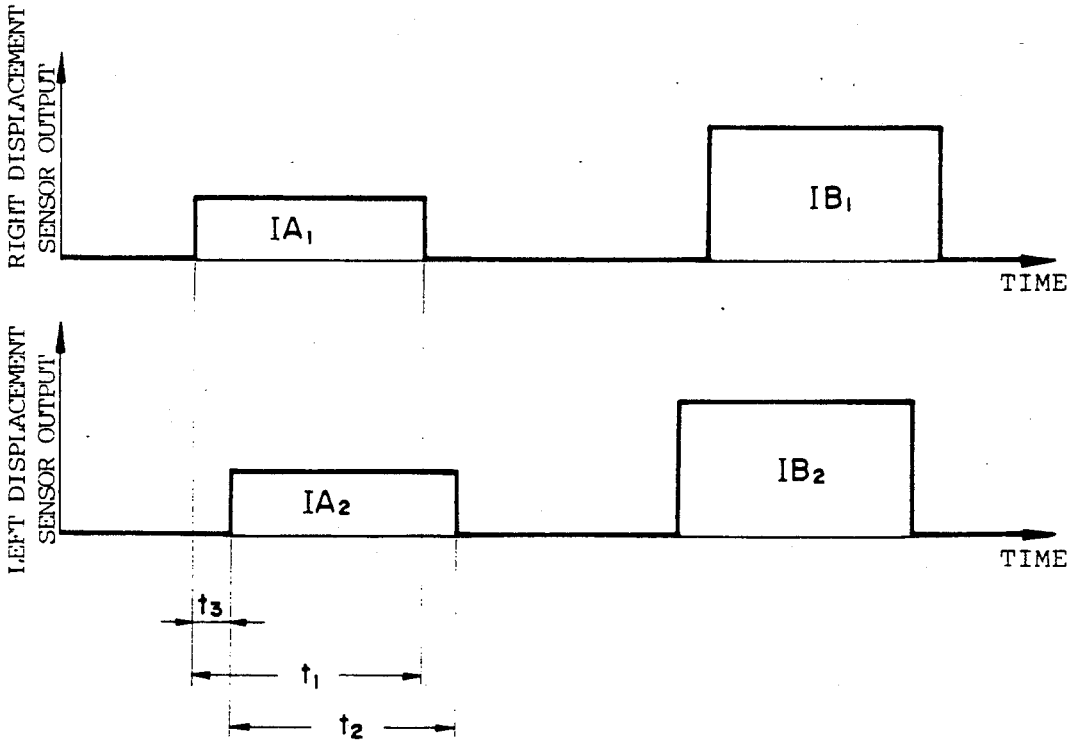
FIG. 6 is a waveform diagram illustrating signals outputted by left and right displacement sensors.

FIGS. 5 and 6 illustrate a comparatively simple case. FIG. 5 illustrates the state in which the bank note B is conveyed, and FIG. 6 illustrates the outputs of the displacement sensors 20. For the sake of explanation, one of the two displacement sensors 20 shall be referred to as a right displacement sensor, and the other shall be referred to as a left displacement sensor.

What is being conveyed in FIG. 5 is a single bank note or two bank notes perfectly superimposed. A skew angle $\theta$ refers to an angle which the longitudinal direction of the bank note B makes with a direction (the direction of a line connecting the centers of the left and right detecting rollers 13) perpendicular to the conveyance direction of the bank note B.

As shown in FIG. 6, when a bank note B is introduced between the rollers 13 and 17, the output signals of the displacement sensors 20 rise, the output levels of these sensors remain substantially constant while the bank note B is passing between the rollers 13, 17, and the output signals decay when the bank note B has passed through the rollers. Let $t_1$ represent the period of time during which the bank note B is being sensed by the right displacement sensor, $t_2$ the period of time during which the bank note B is being sensed by the left displacement sensor, and $t_3$ the time difference between the leading edges of the output signals from both the left and right displacement sensors.

The output signal from the left or right displacement sensor 20 is integrated over the period of time $t_1$ or $t_2$. Let $IA_1$, $IA_2$ represent the respective integrated values which prevail when a single bank note has passed through the rollers 13, 17. Also, let L represent the distance between the left and right detecting rollers 13.

The thickness and skew angle of a bank note which has passed through the rollers are given by the following equations:

$$\text{thickness} = IA_1/t_1 \text{ or } IA_2/t_2 \quad (1)$$

$$\text{skew angle } \theta = \tan^{-1}(V.t_3/L) \quad (2)$$

In Eq. (2), V represents the velocity at which bank notes are conveyed and is a known value decided by the apparatus driving the conveyance path 3. Of course, the value of V can be obtained by measuring the amount of rotation of the roller 17, by way of example.

The length of the bank note B (the length in the conveyance direction of the bank note B, namely the width direction of the bank note B in the present embodiment) is obtained in accordance with the following equation:

$$\text{length} = V \cdot t_1 \cdot \cos\theta \text{ or } V \cdot t_2 \cdot \cos\theta \quad (3)$$

When two bank notes are conveyed in a perfectly superimposed state, the outputs of the left and right displacement sensors 20 become much larger. The integrated values of these enlarged outputs from the right and left displacement sensors are indicated by $IB_1$ and $IB_2$ in FIG. 6. The total thickness of two bank notes is given by the following equation:

$$\text{thickness} = IB_1/t_1 \text{ or } IB_2/t_2 \quad (4)$$

It three or more bank notes are conveyed in a superimposed state, larger integrated values are obtained and the total thickness of the three or more bank notes is found in the same manner.

By predetermining a range of thicknesses which a single bank note can attain, a range of total thicknesses which two bank notes can attain, etc., and performing a check to determine in which range a thickness found in accordance with Eqs. (1), (4), etc. falls, the number of bank notes conveyed between the rollers 13, 17 can be ascertained. If plural types of bank notes are involved, it is preferred that the abovementioned ranges be set for each type of bank note.

Figure 7:
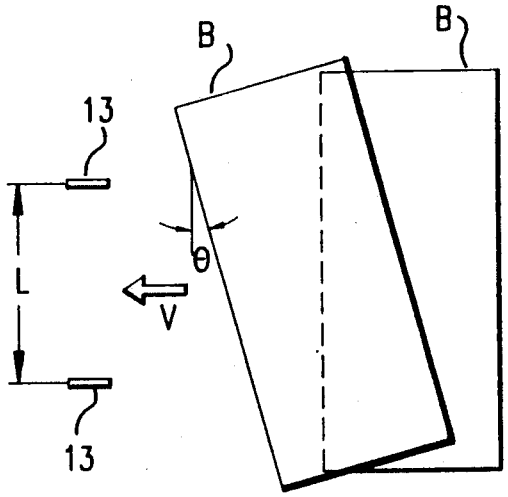
FIG. 7 is a plan view illustrating another state in which bank notes are conveyed.
Figure 8:
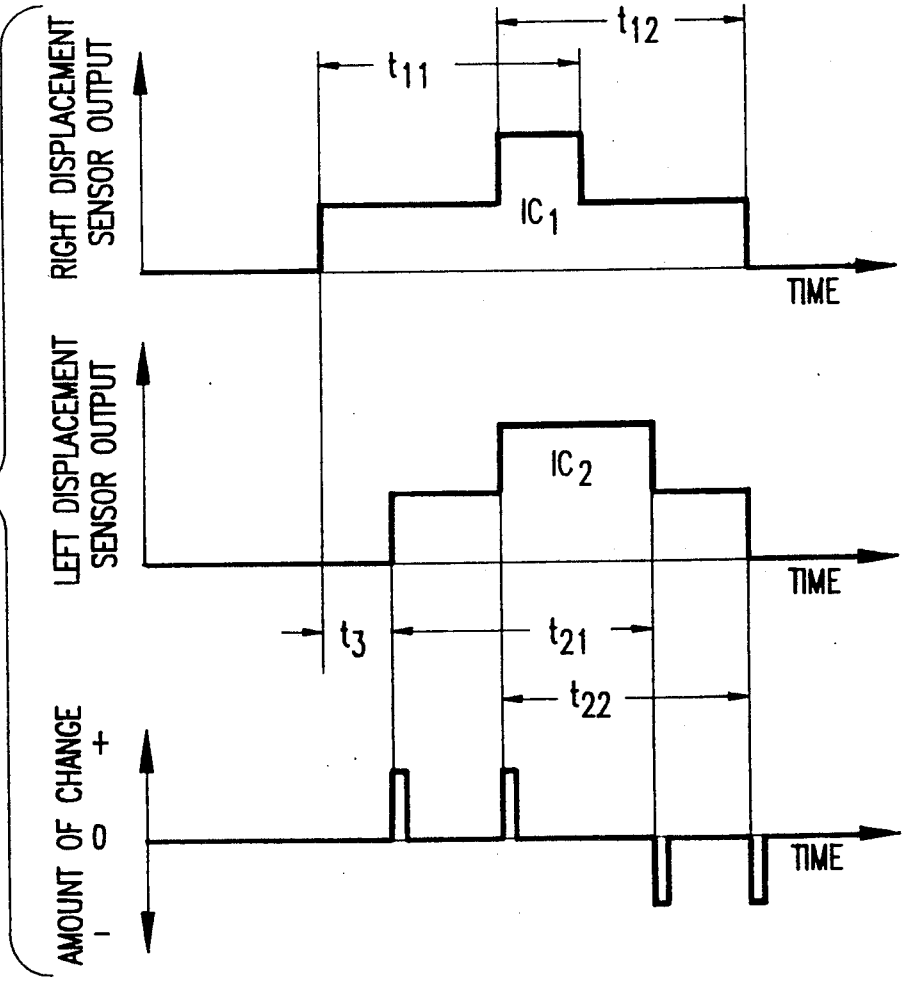
FIG. 8 is a waveform diagram illustrating signals outputted by left and right displacement sensors when the conveyance state of FIG. 7 prevails.

FIGS. 7 and 8 illustrate a somewhat more complicated example. In FIG. 7, two bank notes B are conveyed in a state in which they overlap only partially and, moreover, the leading bank note (namely the bank note farther along in the conveyance direction, referred to hereinafter as the "first" bank note) is skewed. The other bank note (referred to as the "second" bank note) is not skewed. FIG. 8 illustrates the waveforms of the output signals from the right and left displacement sensors which detect these two bank notes.

Let the integrated values of the right and left displacement sensor output signals be $IC_1$ and $IC_2$, respectively. Also, let the time period from the first leading edge to the first trailing edge of the output signal from the right displacement sensor be represented by $t_{11}$, and let the time period from the second leading edge to the second trailing edge of the output signal from this sensor be represented by $t_{12}$. Similarly, let the time period from the first leading edge to the first trailing edge of the output signal from the left displacement sensor be represented by $t_{21}$, and let the time period from the second leading edge to the second trailing edge of the output signal from this sensor be represented by $t_{22}$. Let $t_3$ represent the time period from the first leading edge of the right displacement sensor output to the first leading edge of the left displacement sensor output.

Thickness, skew angle and length of a bank note are given by the following equations:

$$\text{thickness (average value of two bank notes)} = IC_1/(t_{11} + t_{12}) \text{ or } IC_2/(t_{21} + t_{22}) \quad (5)$$

$$\text{skew angle } \theta \text{ (first bank note)} = \tan^{-1}(V \cdot t_3/L) \quad (6)$$

$$\text{length (first bank note)} = V \cdot t_{11} \cdot \cos\theta \text{ or } V \cdot t_{21} \cdot \cos\theta \quad (7)$$

$$\text{length (second bank notes)} = V \cdot t_{12} \text{ or } V \cdot t_{22} \quad (8)$$

The number of bank notes can be detected in the following manner: As shown in FIG. 8, the leading and trailing edges of the output from at least one of the displacement sensors are detected. In FIG. 8, pulses representing the amount of change in displacement sensor output correspond to the leading and trailing edges of the left displacement sensor. The number of bank notes is given by the following:

$$\text{number of bank notes} = \text{number of leading edges} = \text{number of trailing edges} \quad (9)$$

FIG. 9 illustrates a portion of the memory 25. For each of the right and left displacement sensors, the memory 25 is provided with an area for storing sampling data (the output values of the respective displacement sensor), an addition (sum) area for addition processing (in which values obtained by addition represent the integrated values $IA_1$, $IA_2$, . . . , $IC_2$), an area used as a flag (hereinafter referred to as a "bank note presence flag") indicating that a bank note is present, an area used as a flag (hereinafter referred to as an "end flag") indicating the end of a bank note, and areas (not shown) for storing the abovementioned time periods $t_1$, $t_2$, $t_3$, $t_{11}$, $t_{12}$, $t_{21}$, $t_{22}$, etc. detected using the sampling data. The bank note presence flag is turned on when a bank note is passing between the rollers 13 and 17, and the end flag is turned on when a bank note has completely passed through the rollers 13 and 17. Also stored in the memory 25 in advance are values serving as references and values indicating allowable limits which are used in performing the skew check, length check, thickness check and the like.

Figure 10:
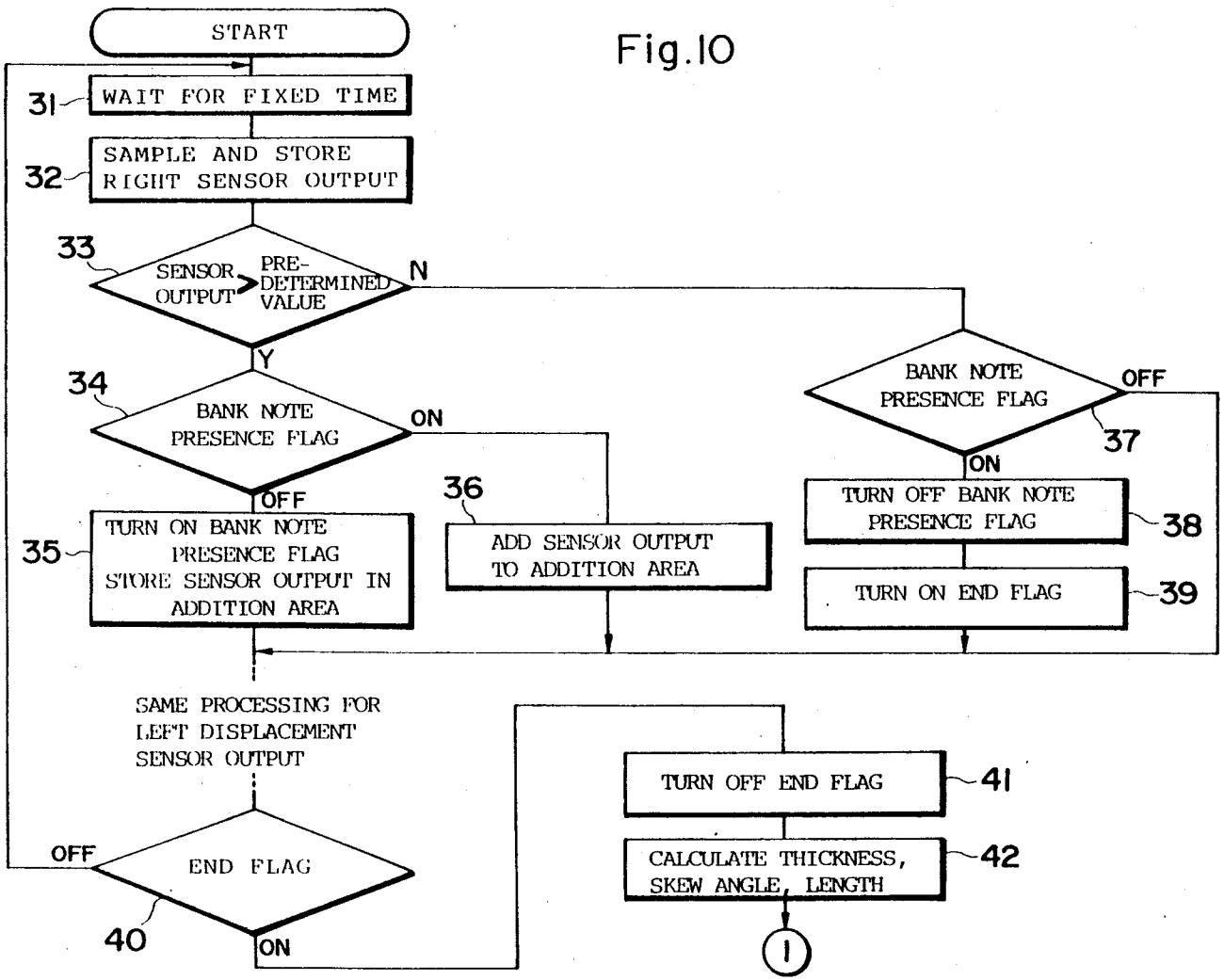
FIG. 10 is a flowchart illustrating a processing procedure for sampling displacement sensor output signals.

FIG. 10 illustrates the processing for accepting output signals from the displacement sensors 20 and for measuring skew angle, length, thickness, etc. relating to bank notes which have passed through the aforementioned rollers.

The output signals from the two displacement sensors are sampled at a fixed period (sampling period) and subjected to an A/D conversion before being accepted by the CPU 24, as described above. When the time required for the sampling period expires at step 31, first the output value of the right displacement sensor is sampled, read in by the CPU 24 and stored in the sampling data area of the memory 25 at step 32. The sampling data are stored in the sample data area in a fixed sequence every sampling. Whether or not a value indicated by the sampling data exceeds a predetermined threshold level is checked at step 33. This threshold level is set to a suitable level less than the thickness of one bank note. When a sampling data value first exceeds this threshold level, it is judged that the leading edge of a bank note B has just been introduced between the rollers 13, 17. More specifically, if a sampling data value exceeds the threshold level and the bank note presence flag is off at step 34, it is judged that a bank note has just been introduced between the rollers 13, 17 and the program proceeds to step 35, at which the bank note presence flag turns on and the sampling data are added to the data (which has initially been cleared to zero) in the addition area of the memory 25. It is permissible to adopt an arrangement in which the processing (step 32) for storing the sampling data is executed from this time onward. When the bank note presence flag is already on at step 34, this means that a bank note is in the process of passing between the rollers 13, 17. Accordingly, the program proceeds to a step 36, at which only processing for adding the sampling data is executed.

If the bank note presence flag is on at step 37 in a case where a value indicated by the sampling data is below the aforementioned threshold level (NO at step 33), this means that the bank note has just passed through the rollers 13, 17. Therefore, the bank note presence flag is turned off at step 38 and the end flag is turned on at step 39. If the bank note presence flag is off at step 37, this means that a bank note is not present and, hence, no processing is executed.

Processing identical with that described above is executed with regard to the left displacement sensor as well.

If the end flags relating to both of the displacement sensors are off or if either one of the flags is off, the foregoing processing is repeated every sampling period.

When both of the end flags turn on at step 40, first both of the end flags are turned off at step 41, then bank note thickness, skew angle and length are calculated at step 42 using the prescribed ones of the equations (1) through (8) given above. The final results of addition in the addition areas are used as the integrated values $IA_1$, $IA_2$, . . . $IC_2$. Data in mutually adjacent sampling data areas are compared in successive fashion. When any of the differences that result exceeds a certain threshold value, it is judged that a leading edge or trailing edge of the displacement sensor has occurred. The time periods $t_1$, $t_2$, . . . , $t_{22}$ are calculated by taking the product of the number of samplings between these leading and trailing edges and the sampling period. The number of leading and trailing edges is also found. Since the velocity V and distance L have already been stored in the memory 25 (a measured value may be used as the velocity V), bank note thickness, skew angle, length and the like can also be calculated.

It is possible to adopt an arrangement in which the aforementioned edge detecting processing is executed at the sampling data storage process(step 32)or at the steps 35, 36. Also, the time period $t_1$, etc. can be clocked by providing a counter which counts the time period $t_1$, starting the counter in response to detection of a leading edge and stopping the counter in response to detection of a trailing edge. The time period $t_3$ can be found by clocking the time from the leading edge of one item of output data from either of the right and left displacement sensors to the leading edge of one item of output data from the other of these displacement sensors.

Figure 11:
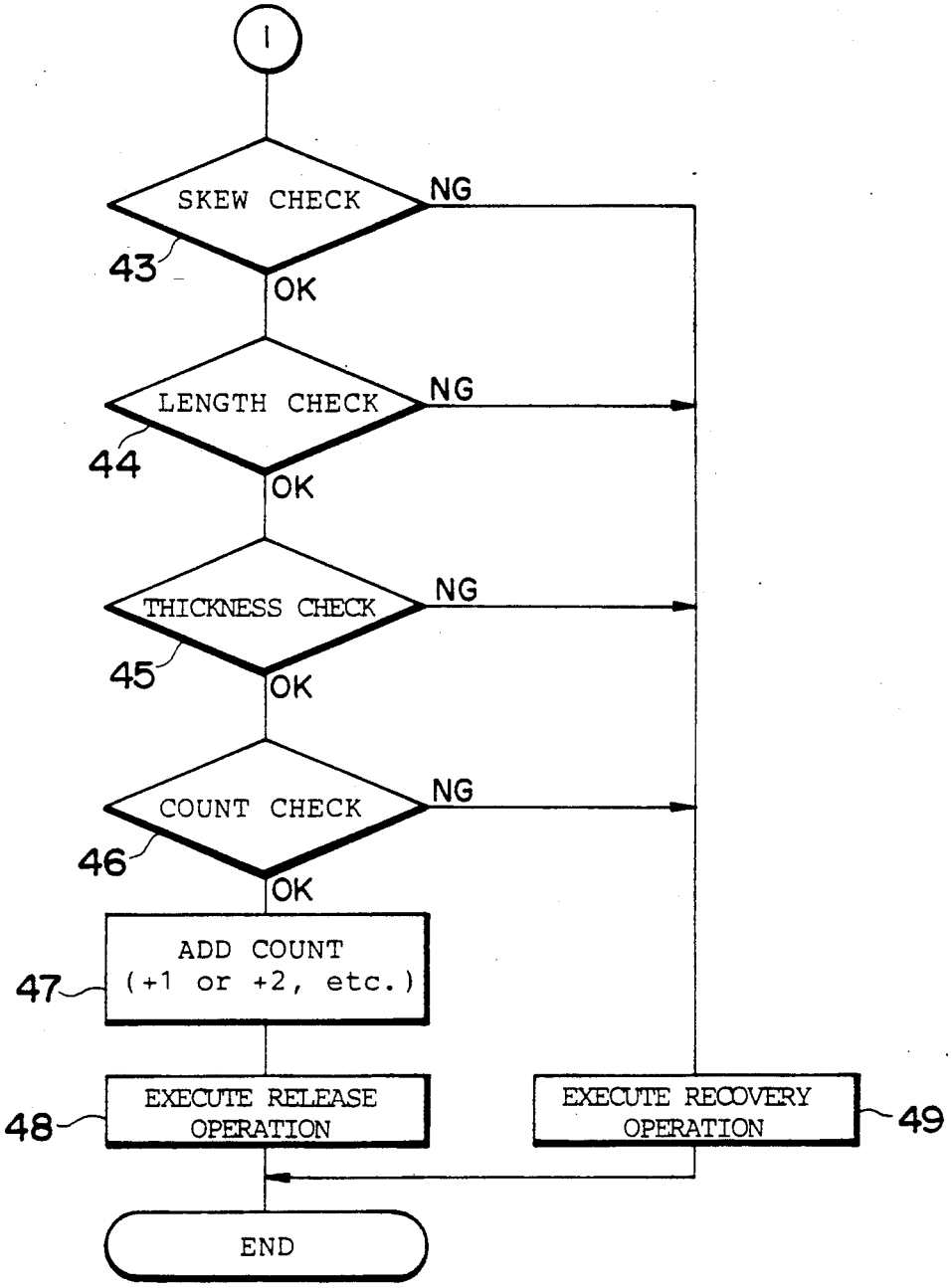
FIG. 11 is a flowchart illustrating processing for performing various checks on bank notes.

FIG. 11 illustrates processing for performing various bank note checking operations based on the results of measuring various of the aforementioned bank note data (bank note parameters).

A skew check is carried out first at step 43. If the skew angle $\theta$ is too large, the skewed bank note may jam the conveyance path. Accordingly, the measured skew angle $\theta$ is compared with an upper-limit angle previously stored in the memory 25. The bank note passes the skew test (OK) if the skew angle is less than the upper-limit value, and fails the skew test (NG) if the skew angle exceeds the upper-limit value.

Next, length and thickness checks are performed at steps 44, 45, respectively. Allowable length limits and allowable thickness limits (upper- and lower-limit values) are stored beforehand in the memory 25. If the measured length and measured thickness fall within the respective limits, OK decisions are rendered; if not, NG decisions are rendered. This represents one kind of test for determining the authenticity of a bank note and assures that only a designated, correct bank note will be released. Preferably, the allowable limits on length and thickness are provided for each type of bank note.

As set forth above, in principle bank notes are delivered one at a time and fed out to the temporary holding mechanism one at a time. Accordingly, a check concerning the number of bank notes is performed. If two bank notes are perfectly superimposed, as shown in FIGS. 5 and 6, an investigation is carried out to determine, based on the thickness obtained in accordance with Eq. (4), whether the number of bank notes is two, three, etc. If two bank notes are partially superimposed, as shown in FIGS. 7 and 8, the number of bank notes is sensed based on the number of detected edges.

In any case, if OK decisions are rendered in the aforementioned skew, length and thickness checking operations when the number of bank notes is judged to be one, the bank note is fed out to the temporary holding mechanism for release and the bank note number counter is incremented to calculate the number of bank notes released (steps 47, 48).

When it is ascertained by the bank note number check that the number of bank notes is two, three or other number, the established number of bank notes is added to the bank note number counter and this number of cards is released. Thus, the number of bank notes requiring to be recovered is reduced. Most preferably, the number of bank notes is established only if the results of the decision based on the output signal of the left displacement sensor agree with the results based on the output signal of the right displacement sensor. Depending upon the particular case, however, it is permissible to render a decision on the established number based solely upon the output signal of one displacement sensor.

If an NG decision is rendered with regard to any one of the checks for skew, length and thickness, or if the number of bank notes is found to be unknown in the bank note number check, the bank note failing the test is recovered in the recovery bin 2 at step 49. It is possible to adopt an arrangement in which the bank note recovery operation is performed if the number of bank notes is found to be two or more in the bank note number check.

The sampling data sometimes become erratic if holes or the like are present in the bank notes. In such a case, it is permissible to render a decision that enables bank note release if the sampling data relating to at least one of the left and right displacement sensors pass all of the aforementioned checking operations. The reason for this is that, in general, if a hole appears it will be in only one portion of a bank note, so that in most cases at least one of the displacement sensors will detect the thickness of a portion free of a hole.

In a case where adhesive tape or the like is affixed to a portion of a bank note, two or more leading edges and two or more trailing edges may occur. In general, however, such a bank note would probably receive an NG in the length check. Thus, it is possible to eliminate bank notes which are defective.

Expedients other than the above-described addition processing can be adopted as integrating means. For example, an arrangement can be adopted in which the output signal of a displacement sensor is integrated by an integrating circuit over a period of time required for a bank note to pass the detecting roller, with the resulting integration signal being A/D-converted and then read in by the CPU. It is also permissible to provide a V/F converter circuit for converting the thickness detection signal of a displacement sensor into a pulsed signal of a frequency corresponding to the voltage of this detection signal, and a counter for counting the output pulses of the V/F converter circuit, operate the counter over a period of time required for a bank note to pass the detecting roller, and cause the CPU to read in the value of the count recorded by the counter. The integrating time of the integrator circuit and the counting time of the counter would be decided by detecting the leading and trailing edges from the offset level of the signal outputted by the displacement sensor.

It is also possible to perform the aforementioned edge detection using an ordinary integrator circuit.

The thickness of a bank note can be determined by a different method in FIGS. 5 and 6. According to this alternative method, use is made of a bank note length W serving as a reference (which length is in the conveyance direction of the bank note B). More specifically, this alternative method is premised on knowing the types of bank notes in advance (or on the fact that only a specific type of bank note is being handled).

In accordance with this alternative method, the thickness of a single bank note B is obtained through the following equation:

$$\begin{aligned} \text{thickness} &= IA_1/(W/\cos\theta) \text{ or } IA_2/(W/\cos\theta) \\ &= (IA_1/W)\cos\theta \text{ or } (IA_2/W)\cos\theta \end{aligned} \tag{10}$$

where $\theta$ is the skew angle given by Eq. (2).

The thickness of two overlapping bank notes is given by the following equation:

$$\begin{aligned} \text{thickness} &= IB_1/(W/\cos\theta) \text{ or } IB_2/(W/\cos\theta) \\ &= (IB_1/W)\cos\theta \text{ or } (IB_2/W)\cos\theta \end{aligned} \tag{11}$$

The thickness of three or more overlapping bank notes is obtained in the same fashion.

If the above-described thickness detection principle is employed, bank note thickness can be accurately obtained even if a portion of the bank note B is folded, as shown in FIG. 12, and even if two bank notes B partially overlap each other, as depicted in FIG. 14.

FIG. 12 illustrates a state in which one edge portion of a conveyed bank note B is folded. For the sake of description, it will be assumed here that the skew angle $\theta$ is 0°. Though the length (width) of the bank note B is W, as shown by the phantom lines in FIG. 12, the apparent length is smaller, namely a value of W-w (where w stands for the length of the fold), since a portion of the bank note is folded over on itself. FIG. 13 illustrates the output signal waveform of e.g. the left displacement sensor 20 of the left and right displacement sensors 20 that detect the bank note B.

In FIG. 13, let $ID_1$ (the interval from A to B) represent the integrated value of the output signal from the displacement sensor 20 corresponding to the folded portion of the bank note B, and let $ID_2$ (the interval from B to C) represent the integrated value of the displacement sensor output signal corresponding to unfolded portion of the bank note B.

The thickness of the bank note B is given by the following, derived from Eq. (10) or (11):

$$thickness = (ID_1 + ID_2)/W$$

(skew angle $\theta = 0°$, $\cos\theta = 1$)

Since the integrated value $ID_1$ represents the doubled portion of the bank note, the total of the integrated values $ID_1 + ID_2$ (the interval A to C) is a value the same as the integrated value of the displacement sensor output signal obtained when the unfolded bank note is detected. The end result is that data representing the thickness of one sheet of the bank note B is obtained.

FIG. 14 illustrates a state in which bank notes B of length W partially overlap each other (the amount of overlap is indicated by $w_1$). As in FIG. 12, it is assumed here that the skew angle $\theta$ is 0°. FIG. 15 illustrates the output signal waveform of the left displacement sensor which detects these bank notes B.

In FIG. 15, let $IE_1$ (the interval D to E) represent the integrated value of the output signal from the displacement sensor 20 that relates to the portion of the first bank note $B_1$ not overlapped by the second bank note $B_2$, let $IE_3$ (the interval F to G) represent the integrated value of the output signal from the displacement sensor 20 that relates to the portion of the second bank note $B_2$ not overlapped by the first bank note $B_1$, and let $IE_2$ (the interval E to F) represent the amount of overlap of the bank notes $B_1$ and $B_2$.

The thickness is given by the following equation in accordance with Eq. (10) or (11):

$$thickness=(IE_1+IE_2+IE_3)/W$$

(skew angle $\theta=0°$, $\cos\theta=1$)

The total of the integrated values $IE_1+IE_2+IE_3$ (the interval D to G) is a value the same as the integrated value of the displacement sensor output signal obtained when two bank notes B are perfectly superimposed and the unfolded portion of the bank note is detected. The thickness obtained by dividing this value by the length W represents the thickness of two bank notes. Thus, it is possible to sense two overlapping bank notes.

Figure 16:
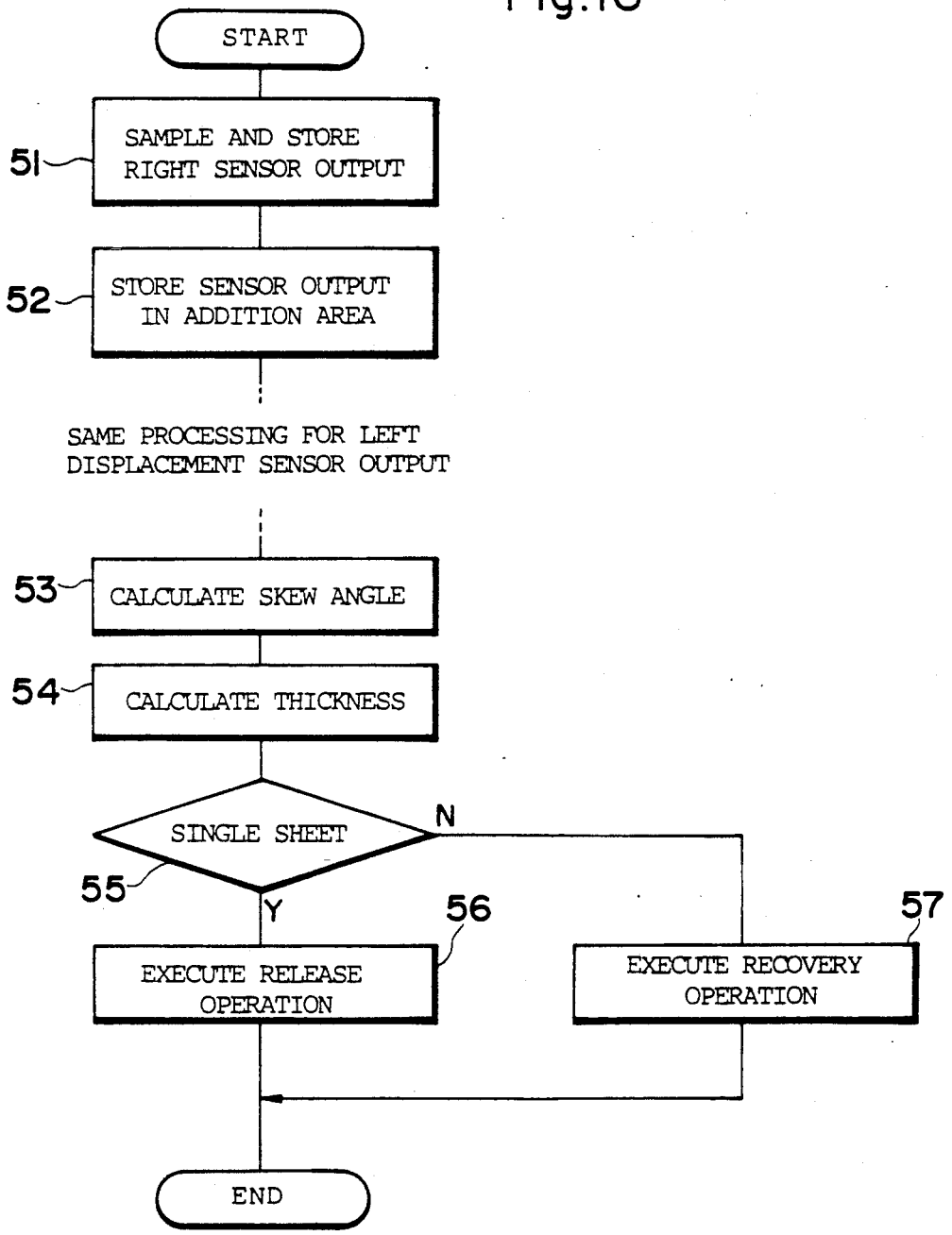
FIG. 16 is a flowchart illustrating a processing procedure for detecting the thickness of paper sheets.

FIG. 16 illustrates the processing for detecting thickness by accepting output signals from the displacement sensors 20 and measuring the skew angle of bank notes which have passed through the aforementioned rollers.

The output signals from the two displacement sensors 20 are sampled at a fixed period (sampling period) and subjected to an A/D conversion before being accepted by the CPU 24. When the time required for the sampling period expires, first the output value of the right displacement sensor is sampled, read in by the CPU and stored in the sampling data area of the memory 25 at step 51. The sampling data are stored in the sample data area in a fixed sequence every sampling. Whether or not a value indicated by the sampling data exceeds a predetermined threshold level is checked. This threshold level is set to a suitable level less than the thickness of one bank note. When a sampling data value first exceeds this threshold level, it is judged that the leading edge of a bank note B has just been introduced between the rollers 13, 17. The sampling data are added to the data (which has initially been cleared to zero) in the addition area of the memory 25 (step 52).

Processing identical with that described above is executed with regard to the left displacement sensor as well.

Next, the skew angle is calculated using Eq. (2) at step 53. The velocity V and distance L are previously stored in the memory 25, though a measured value can be used with regard to the velocity V.

This is followed by step 54, at which the thickness of a bank note is calculated in accordance with Eq. (10) or (11) using the skew angle found at step 53 and the reference length W of the bank note B. Whether or not the thickness calculated indicates the thickness of a single bank note sheet is checked at step 55.

Allowable thickness limits (upper- and lower-limit values) are stored beforehand in the memory 25. If the measured thickness falls within the allowable limits, a YES answer, which is indicative of a single bank note sheet, is received at step 55; if not, a NO answer indicating two or more bank note sheets is received at step 55. Preferably, the allowable limits on thickness are provided for each type of bank note.

When the number of bank notes is judged to be one in the bank note count checking operation, the bank note is fed out to the temporary holding mechanism (not shown) for release and the bank note number counter (not shown) is incremented to calculate the number of bank notes released (step 56).

When it is ascertained by the bank note number check that the number of bank notes is two or more, these bank notes are recovered at step 57.

It is especially desirable to perform a skew angle check in the course of processing. Also, an arrangement can be adopted in which, if the number of overlapping bank notes is established in a case where a decision is rendered to the effect that two or more bank notes are overlapping, this number of bank notes is added to the counter and the bank notes are released without being recovered.

As many apparently widely different embodiments of the present invention can be made without departing from the spirit and scope thereof, it is to be understood that the invention is not limited to the specific embodiments thereof except as defined in the appended claims.

What is claimed is:

1. A paper sheet handling apparatus comprising:

at least two thickness detectors arranged spaced apart with a spacing therebetween in a direction perpendicular to a conveyance path along which paper sheets are conveyed, said spacing being adapted to be slightly less than a width of a paper sheet, each of said thickness detectors including a respective displacement sensor for providing an analog electrical output signal having an amplitude representing a thickness of said paper sheet conveyed along said path;

means for measuring a time difference between leading edges of the analog output signals from the two displacement sensors and detecting a skew angle of a paper sheet conveyed along said path by using the measured time difference;

means for integrating the output signal from at least one of said two displacement sensors over a period of time required for the paper sheet to pass by said thickness detectors;

arithmetic means for calculating the thickness of the paper sheet from the detected skew angle, the integrated value and a reference length of said paper sheets in a direction longitudinal of said conveyance path of the paper sheets.

2. An apparatus for detecting parameters of paper sheets, comprising:

at least two thickness detectors arranged spaced apart with a spacing therebetween in a direction perpendicular to a conveyance path along which paper sheets are conveyed, said spacing being adapted to be slightly less than a width of a paper sheet; and arithmetic means for calculating parameters of paper sheets conveyed along said path based on output signals produced by said thickness detectors, said parameters including information relating to a skew of a paper sheet conveyed between said detectors;

each of said thickness detectors comprising:

a receiving member provided on one side of the conveyance path of the paper sheets;

a detecting roller provided opposite said receiving member on the other side of the conveyance path and urged in a direction to contact said receiving member, said detecting roller being free to move toward and away from said receiving member; and a displacement sensor for outputting an electric analog output signal representing an amount of displacement of said detecting roller displaced by a paper sheet conveyed along said path between said receiving member and said detecting roller, said displacement sensor including a light projector and a light receiver for receiving at least a portion of the light projected from the light projector, an amount of said light received by said light receiver varying in accordance with said amount of displacement of said detecting roller, and an amplitude of said electric analog output signal being based on said amount of light received by said light receiver.

3. The apparatus according to claim 2, wherein said detecting roller is freely rotatably provided substantially midway along a detecting lever pivoted at one end and biased by a spring, and said displacement sensor is arranged so as to detect a magnified amount of displacement of another end of said detecting lever.

4. The apparatus according to claim 2, wherein said receiving member is a freely rotatable roller.

5. The apparatus according to claim 2, wherein parameters of paper sheets are skew angle, length and thickness.

6. The apparatus according to claim 2, further comprising means for integrating the electric signal outputted by said displacement sensor.

7. The apparatus according to claim 2, further comprising means for detecting a leading edge and a trailing edge of the electric signal outputted by said displacement sensor.

8. The apparatus according to claim 2, further comprising:

means for integrating the electric signal outputted by said displacement sensor;

means for keeping time from a leading edge of the electric signal outputted by said displacement means to a trailing edge corresponding to said leading edge; and means for detecting thickness of a paper sheet by dividing an integrated value provided by said integrating means by a total sum of the time provided by said timekeeping means.

9. The apparatus according to claim 2, further comprising:

means for detecting leading edges of electric signals outputted by both of said displacement sensors;

means for keeping time from a leading edge of the electric signal outputted by one of said displacement sensors to a leading edge of the electric signal outputted by the other of said displacement sensors; and means for detecting a skew angle using the time kept by said timekeeping means.

10. The apparatus according to claim 9, further comprising:

means for keeping time from the leading edge to a corresponding trailing edge of the electric signal outputted by one of said displacement sensors, and means for calculating length of a paper sheet by using the time kept by said timekeeping means and the skew angle calculated by said skew angle detecting means.

11. A paper sheet releasing apparatus comprising:

at least two thickness detectors arranged spaced apart with a spacing therebetween in a direction perpendicular to a conveyance path along which paper sheets are conveyed, said spacing being adapted to be slightly less than a width of a paper sheet, each of said thickness detectors providing an analog electrical output signal having an amplitude representing a thickness of said paper sheet conveyed along said path, wherein each of said thickness detectors comprises:

a receiving member provided on one side of the conveyance path of the paper sheets;

a detecting roller provided opposite said receiving member on the other side of the conveyance path and urged in a direction to contact said receiving member, said detecting roller being free to move toward and away from said receiving member, said detecting roller being freely rotatable and provided substantially midway along a detecting lever pivoted at one end and biased by a spring; and a displacement sensor for outputting an electric signal representing an amount of displacement of said detecting roller displaced by a paper sheet conveyed between said receiving member and said detecting roller, wherein said displacement sensor is arranged so as to detect a magnified amount of displacement of another end of said detecting lever; and means for calculating the number of paper sheets conveyed along said path based on output signals produced by the displacement sensors of said thickness detectors; and means for counting the calculated number of paper sheets as a number of paper sheets which have been released.

12. A paper sheet releasing apparatus comprising:

at least two thickness detectors arranged spaced apart with a spacing therebetween in a direction perpendicular to a conveyance path along which paper sheets are conveyed, said spacing being adapted to be slightly less than a width of a paper sheet, each of said thickness detectors including a respective displacement sensor for providing an analog electrical output signal having an amplitude representing a thickness of a said paper sheet conveyed along said path;

means for calculating the number of paper sheets conveyed along said path based on output signals produced by said displacement sensors, wherein said paper sheet number calculating means comprises:

means for detecting leading and trailing edges of the output signals of said displacement sensors; and first means for counting the detected leading and second means for counting the calculated number of paper sheets as a number of paper sheets which have been released.

13. A paper sheet releasing apparatus comprising:

at least two thickness detectors arranged spaced apart with a spacing therebetween in a direction perpendicular to a conveyance path along which paper sheets are conveyed, said spacing being adapted to be slightly less than a width of a paper sheet, each of said thickness detectors including a respective displacement sensor for providing an analog electrical output signal having an amplitude representing a thickness of said paper sheet conveyed along said path;

means for calculating the number of paper sheets conveyed along said path based on output signals produced by said displacement sensors, wherein said paper sheet number calculating means comprises:

means for integrating the electric signal outputted by at least one of said displacement sensors to produce an integrated value;

means for keeping time from a leading edge of the electric signal outputted by said at least one displacement sensor to a trailing edge following said leading edge;

means for detecting the thickness of a paper sheet by dividing the integrated value provided by said integrating means by a total sum of the time provided by said timekeeping means; and means for determining a number of paper sheets by comparing the detected thickness with a given reference value; and means for counting the calculated number of paper sheets as a number of paper sheets which have been released.

14. An apparatus for detecting the thickness of paper sheets, comprising:

at least two thickness detectors arranged spaced apart with a spacing therebetween in a direction perpendicular to a conveyance path along which paper sheets are conveyed, said spacing being adapted to be slightly less than a width of a paper sheet;

means for measuring a time difference between leading edges of output signals from the two thickness detectors and detecting a skew angle of a paper sheet conveyed along said path by using the measured time difference;

means for integrating the output signal from at least one of said two thickness detectors over a period of time required for the paper sheet to pass by said thickness detectors; and arithmetic means for calculating the thickness of the paper sheet from the detected skew angle, the integrated value and a reference length in a direction longitudinal of said conveyance path of the paper sheets.

15. The apparatus according to claim 14, wherein each of said thickness detectors comprises:

a receiving member provided on one side of the conveyance path of the paper sheets;

a detecting roller provided opposite said receiving member on other side of the conveyance path and urged in a direction to contact said receiving member, said detecting roller being free to move toward and away from said receiving member; and a displacement sensor for outputting an electric signal representing an amount of displacement of said detecting roller displaced by a paper sheet conveyed between said receiving member and said detecting roller.

16. The apparatus according to claim 15, wherein said detecting roller is freely rotatably provided substantially midway along a detecting lever pivoted at one end and biased by a spring, and said displacement sensor is arranged so as to detect a magnified amount of displacement of another end of said detecting lever.

17. The apparatus according to claim 15, wherein said receiving member is a freely rotatable roller.

18. A paper sheet handling apparatus comprising:

at least two thickness detectors arranged spaced apart with a spacing therebetween in a direction perpendicular to a conveyance path along which paper sheets are conveyed, said spacing being adapted to be slightly less than a width of a paper sheet;

each of said thickness detectors including a respective displacement sensor for providing an electric analog signal representing an amount of displacement caused by a paper sheet conveyed along said path;

skew determining means connected to the displacement sensors for determining a skew angle of a paper sheet conveyed along said path between said detectors based on a time difference between predetermined edges of the output signals from said two displacement sensors.

19. A paper sheet handling apparatus comprising:

at least two thickness detectors arranged spaced apart with a spacing therebetween in a direction perpendicular to a conveyance path along which paper sheets are conveyed, said spacing being adapted to be slightly less than a width of a paper sheet;

a displacement sensor in each of said thickness detectors for providing an electric analog signal representing an amount of displacement of each of said thickness detectors displaced by said paper sheet conveyed along said path;

skew determining means for determining a skew angle of a paper sheet conveyed along said path between said detectors, said skew determining means further comprising: timing means for providing a timing signal based on predetermined edges of said output signals from said displacement sensors; detecting means for detecting a skew angle of said conveyed paper sheet based on a time difference between said leading edges of said output signals; and determining means for determining said skew angle by using said measured time difference; and means for comparing said skew angle with a predetermined upper-limit angle.

* * * * *